US011231688B2

(12) United States Patent
Yamamoto

(10) Patent No.: US 11,231,688 B2
(45) Date of Patent: Jan. 25, 2022

(54) ELECTRONIC TIMEPIECE HAVING AN ANTENNA HOLDING A TIMEPIECE PART

(71) Applicant: Seiko Epson Corporation, Tokyo (JP)

(72) Inventor: Hironobu Yamamoto, Shiojiri (JP)

(73) Assignee: Seiko Epson Corporation

( * ) Notice: Subject to any disclaimer, the term of this patent is extended or adjusted under 35 U.S.C. 154(b) by 240 days.

(21) Appl. No.: 16/543,714

(22) Filed: Aug. 19, 2019

(65) Prior Publication Data

US 2020/0057415 A1 Feb. 20, 2020

(30) Foreign Application Priority Data

Aug. 20, 2018 (JP) ..... JP2018-153991

(51) Int. Cl.
*G04R 60/10* (2013.01)
*G04C 10/02* (2006.01)
*G04G 17/04* (2006.01)

(52) U.S. Cl.
CPC ..... *G04R 60/10* (2013.01); *G04C 10/02* (2013.01); *G04G 17/04* (2013.01)

(58) Field of Classification Search
CPC ..... G04R 60/10; G04R 20/02; G04C 10/02; G04G 17/04; G04G 17/06; G04G 19/00; G04G 17/08
USPC ..... 368/278
See application file for complete search history.

(56) References Cited

U.S. PATENT DOCUMENTS

| | | | | |
|---|---|---|---|---|
| 8,964,511 | B2 * | 2/2015 | Fujisawa | G04R 60/12 368/47 |
| 9,030,362 | B2 * | 5/2015 | Abe | G04R 60/10 343/718 |
| 9,823,625 | B2 * | 11/2017 | Abe | G04R 20/04 |
| 2011/0051561 | A1 * | 3/2011 | Fujisawa | G04C 10/02 368/47 |
| 2011/0102274 | A1 * | 5/2011 | Fujisawa | H01Q 7/00 343/702 |
| 2018/0239308 | A1 | 8/2018 | Yamamoto et al. | |

FOREIGN PATENT DOCUMENTS

| | | |
|---|---|---|
| JP | 2012-093211 A | 5/2012 |
| JP | 2018-136296 A | 8/2018 |
| JP | 2019-163963 A | 9/2019 |

* cited by examiner

*Primary Examiner* — Edwin A. Leon
(74) *Attorney, Agent, or Firm* — Harness, Dickey & Pierce, P.L.C.

(57) ABSTRACT

Provided is an electronic timepiece enabling reducing the size of an electronic timepiece. The electronic timepiece has an antenna having a first conductor element connected to a feed, a second conductor element superimposed with the first conductor element in plan view, and a dielectric disposed between the first conductor element and second conductor element, and the antenna holds a specific timepiece part. The specific timepiece part is preferably a dial, solar panel, or circuit board. The antenna also preferably has a shorting element that shorts the first conductor element and second conductor element.

12 Claims, 9 Drawing Sheets

ELECTRONIC TIMEPIECE HAVING AN ANTENNA HOLDING A TIMEPIECE PART

CROSS REFERENCE TO RELATED APPLICATIONS

This application is based upon Japanese Patent Application No. 2018-153991 filed on Aug. 20, 2018, the entire contents of which are incorporated by reference herein.

BACKGROUND

1. Technical Field

The present invention relates to an electronic timepiece.

2. Related Art

When a GPS (Global Positioning System) receiver is built into the case of an electronic timepiece such as a wristwatch, the size of the antenna used for the receiver must be minimized. JP-A-2012-93211, for example, describes an electronic timepiece that has an patch antenna capable of receiving GPS satellite signals from GPS satellites disposed between the dial and the main plate.

A problem with the technology taught in JP-A-2012-93211 is that the thickness of the electronic timepiece is increased by the thickness of the patch antenna.

SUMMARY

An electronic timepiece according to an aspect of the invention has an antenna having a first conductor element connected to a feed, a second conductor element superimposed with the first conductor element in plan view, and a dielectric disposed between the first conductor element and second conductor element, and the antenna holds a specific timepiece part.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the invention are described below with reference to the accompanying figures. The dimensions and scale of parts shown in the figures differ from the actual dimensions and scale, and there are parts shown schematically for ease of understanding. The scope of the invention is also not limited to the following unless such limitation is expressly stated.

1. Embodiment 1

2. 1-1. GPS Including an Electronic Timepiece

Figure 1:
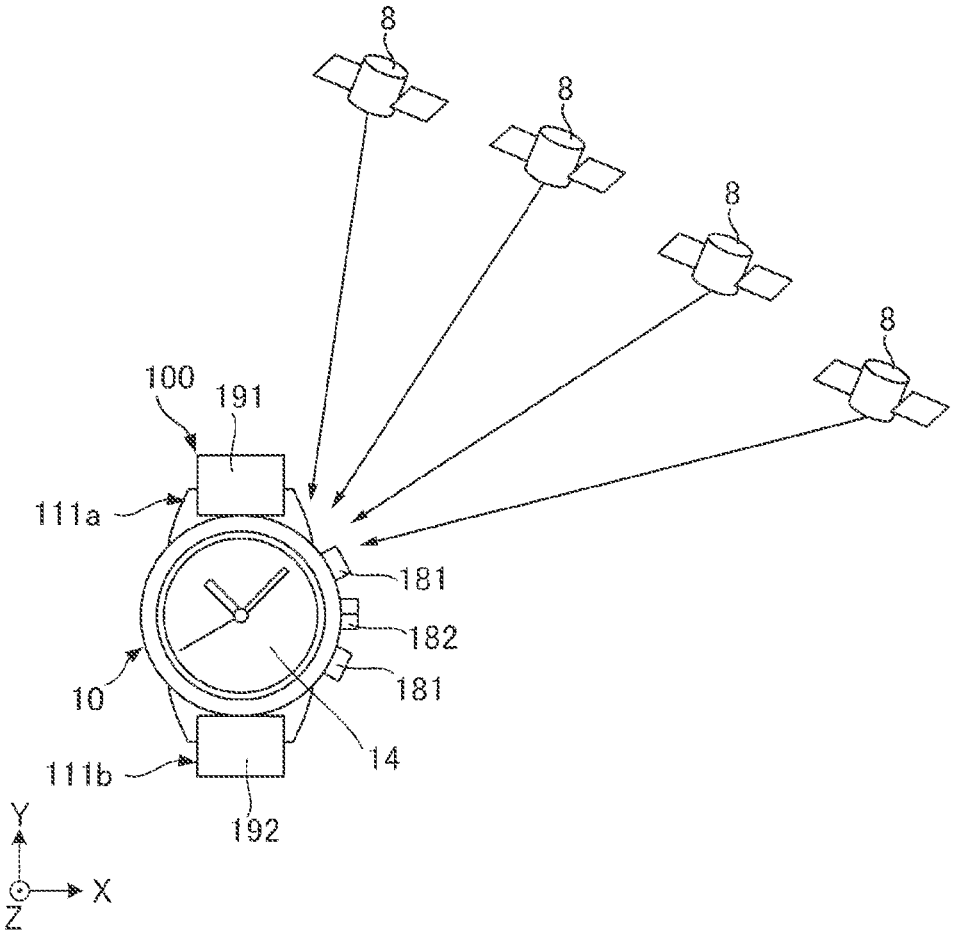
FIG. 1 schematically illustrates the configuration of a GPS system including an electronic timepiece according to a first embodiment of the invention.

FIG. 1 illustrates the concept of a GPS system including an electronic timepiece according to the first embodiment of the invention. The electronic timepiece 100 shown in FIG. 1 is a wristwatch that receives wireless signals transmitted from at least one of multiple GPS satellites 8, and adjusts the internal time based on the received signals.

The GPS satellites 8 are positioning information satellites (navigation satellites) orbiting the Earth in space on known orbits, and transmit a navigation message superimposed on a 1.57542 GHz carrier wave to Earth. The 1.57542 GHz carrier wave on which the navigation message is superimposed is referred to below as a satellite signal. These satellite signals are right-hand circularly polarized waves.

Each GPS satellite 8 carries an atomic clock, and GPS time information, which is extremely precise time information kept by the atomic clock, is included in the satellite signals. The slight time difference of the atomic clock onboard each GPS satellite 8 is measured by a terrestrial control segment, and a time correction parameter for correcting this time difference is also included in the satellite signals. The electronic timepiece 100 receives satellite signals transmitted from one GPS satellite 8, and using the GPS time information and time correction parameter in the satellite signals adjusts the internal time to the correct time.

Orbit information indicating the position of the GPS satellite 8 on its orbit is also carried in the satellite signals. The electronic timepiece 100 can also calculate its location using the GPS time information and the orbit information. This navigation calculation supposes that there is a degree of difference in the internal time of the electronic timepiece 100. More specifically, in addition to the x, y, z parameters for determining the location of the electronic timepiece 100 in three-dimensional space, this time difference is an unknown value. As a result, the electronic timepiece 100 typically receives satellite signals transmitted from four or more GPS satellites 8, and uses the GPS time information and orbit information from each GPS satellite 8 to calculate the location.

1-2. Configuration of the Electronic Timepiece

For brevity, the following description references the three mutually perpendicular X-axis, Y-axis, and Z-axis shown in FIG. 1. In this description of the invention, the view from the Z-axis is referred to as a plan view. The surface of the electronic timepiece 100 that contacts the wrist of the user is referred to as the back side, and the opposite side is referred to as the face side. In addition, the direction from the back cover 12 to the crystal 14 is parallel to the Z-axis.

As shown in FIG. 1, the electronic timepiece 100 can be worn on the wrist of the user. The electronic timepiece 100 has a case 10, crystal 14, and a pair of bands 191 and 192. The pair of bands 191 and 192 are attachment members used to attach the case 10 to the user.

The case 10 also has lugs 111*a* for attaching one band 191, and lugs 111*b* for attaching the other band 192. The lugs 111*a* and 111*b* are parts that hold the corresponding band 191 or band 192 therebetween. While not shown in the figure, holes into which pins for attaching the corresponding band 191 or band 192 are also formed in the lugs 111*a* and lugs 111*b*.

A crown 181, and multiple buttons 182, are also disposed to the case 10. The user can change the display on the electronic timepiece 100, for example, by operating the crown 181 and multiple buttons 182.

Note that the shape of the case 10 in plan view is round in FIG. 1, but the shape in plan view is not so limited and may be square or other polygonal shape.

Figure 2:
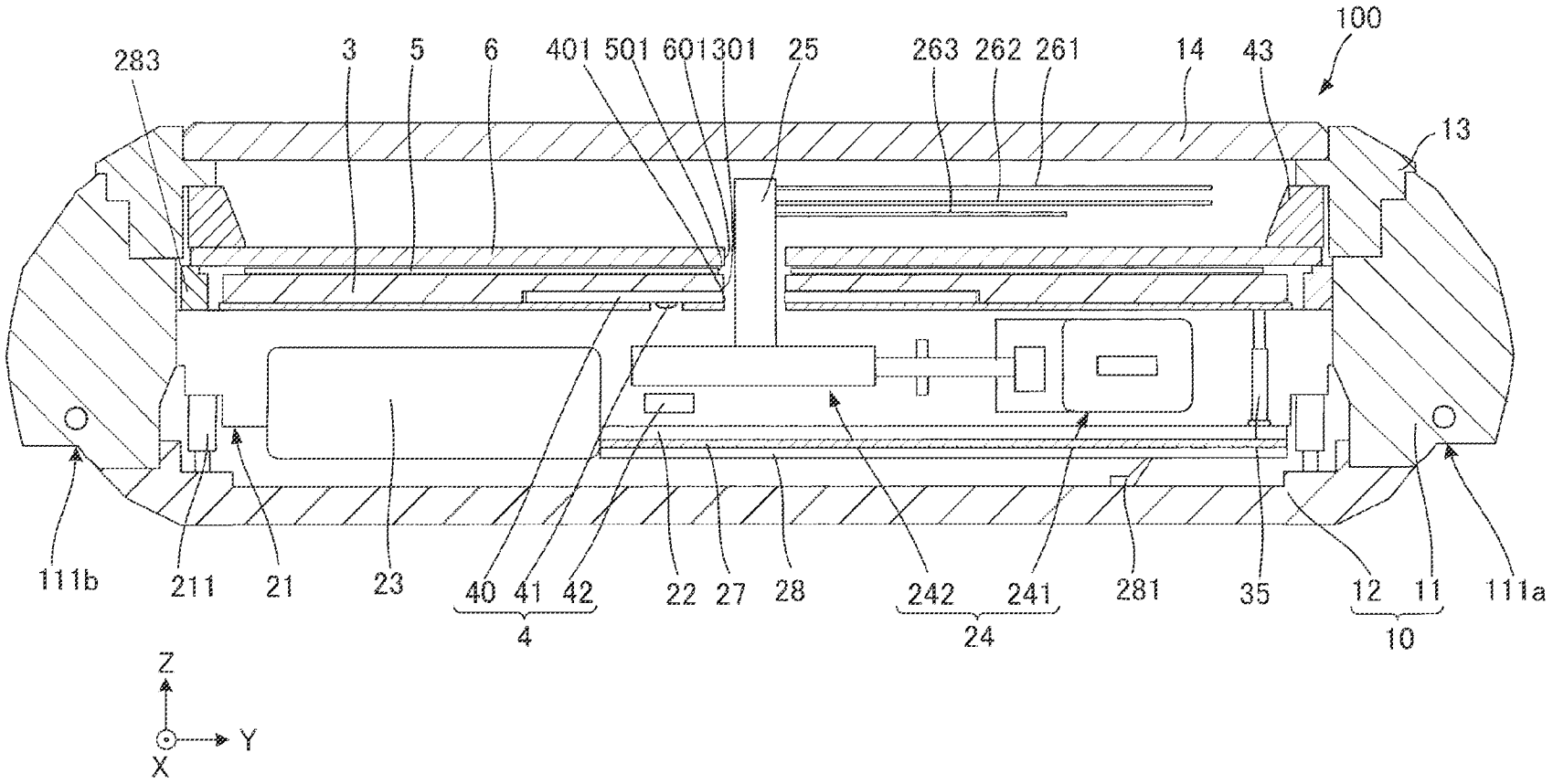
FIG. 2 is a section view of the electronic timepiece according to the first embodiment of the invention.

FIG. 2 is a section view of the electronic timepiece according to the first embodiment of the invention. As shown in FIG. 2, the electronic timepiece 100 has a main plate 21, a control circuit board 22, a storage battery 23, a drive mechanism 24, a pivot 25, multiple hands 261, 262, and 263, an antenna 3, an LED (light emitting diode) circuit board 40 as a timepiece part, a light-emitting device 41, a photodetector 42, a solar panel 5, and a dial 6. These parts are disposed inside the case 10. A detector 4 is configured by the LED circuit board 40, light-emitting device 41, and photodetector 42.

The case 10 includes a cylindrical case body 11 having two major openings, and a back cover 12 that closes the opening of the case body 11 on the back cover side. The case body 11 and back cover 12 are discrete parts in this embodiment, but may be configured in unison. An annular bezel 13 is disposed on the face side of the case body 11. An optically transparent, flat crystal 14 is disposed inside the bezel 13.

The materials from which the case 10 and bezel 13 are made are not specifically limited, and may be a plastic material or a metal such as stainless steel. For example, by configuring the case 10 and bezel 13 with conductive materials, the inside of the case 10 can be shielded from external noise. By making the case 10 from metal, the electronic timepiece 100 can be given a high quality appearance.

The crystal 14 may be made from glass or various plastic materials.

The main plate 21 is pushed up and positioned in the Z-axis direction by a case ring 211. Multiple recesses for holding the storage battery 23 and drive mechanism 24 are formed in the main plate 21. Various plastic materials can be used to configure the main plate 21.

The storage battery 23 is charged by power produced by a solar panel 5 described below, and supplies power to the drive mechanism 24 and other parts. The storage battery 23 may be a lithium ion storage battery, for example.

The drive mechanism 24 includes a stepper motor 241 as the drive source, and a wheel train 242 as a power transfer mechanism that transfers drive power from the stepper motor 241 to the pivot 25. The pivot 25 is connected to the drive mechanism 24, and the pivot 25 can be driven rotationally by the drive mechanism 24.

The pivot 25 extends from the main plate 21 toward the crystal 14. Multiple hands 261, 262, 263 for indicating the time are attached to the pivot 25. The multiple hands 261, 262, 263 are located on the crystal 14 side of the dial 6, and rotate on the pivot 25.

A control circuit board 22 is disposed on the back cover side of the main plate 21. The control circuit board 22 controls driving parts of the electronic timepiece 100. The control circuit board 22 includes a control circuit that controls driving the stepper motor 241, for example. This control circuit includes, for example, a CPU (Central Processing Unit), RAM (Random Access Memory), and a RTC (real time clock).

On the opposite side of the control circuit board 22 as the main plate 21 is disposed a magnetic shield 27 that protects the drive mechanism 24 and control circuit board 22 from external magnetic fields.

On the opposite side of the magnetic shield 27 as the control circuit board 22 is disposed a circuit board holder 28 that supports the control circuit board 22 and magnetic shield 27. The circuit board holder 28 is conductively connected to the back cover 12 by a conductive spring 281.

The antenna 3 is disposed on the face side of the main plate 21. The antenna 3 is a planar inverted-F antenna, and receives satellite signals. In the center of the antenna 3 in plan view is a through-hole 301 through which the pivot 25 passes. The antenna 3 is also disposed separated from the case body 11. The shorter the distance between the antenna 3 and the case body 11, the greater the current that flows to the case body 11 in the opposite direction as the current flowing to the antenna 3. As a result, radio waves reaching the antenna 3 are cancelled by the effect of the current, and the sensitivity of the antenna 3 drops. A drop in the sensitivity of the antenna 3 can therefore be suppressed by separating the antenna 3 and the case body 11.

The LED circuit board 40 is disposed on the back cover side of the antenna 3. A through-hole 401 through which the pivot 25 passes is also formed in the center of the LED circuit board 40 in plan view.

A flat solar panel 5 is disposed on the face side of the antenna 3. The solar panel 5 converts light from the sun or other source to electrical energy. A through-hole 501 through which the pivot 25 passes is also formed in the center of the solar panel 5 in plan view.

The antenna 3, LED circuit board 40, and solar panel 5 described below in detail.

A flat dial 6 is disposed on the opposite side of the solar panel 5 as the antenna 3. The dial 6 is fastened by an annular fastening member 283 surrounding the antenna 3, and is separated from the solar panel 5.

A through-hole 601 through which the pivot passes 25 is also formed in the center of the dial 6 in plan view. Note that through-hole 601 is aligned with through-holes 301, 401 and 501.

The dial 6 is an optically transparent insulator, and is made from a resin material such as polycarbonate.

An annular dial cover 43 is disposed on the face side of the dial 6 and covers the outside edge of the dial 6. The material used for the dial cover 43 is not specifically limited, and is preferably a resin material to suppress blocking the signals the antenna 3 receives.

The basic configuration of the electronic timepiece 100 is described above, and the electronic timepiece 100 may obviously have parts other than those described above.

1-3. Configuration of the Antenna, Solar Panel and LED Circuit Board

Figure 3:
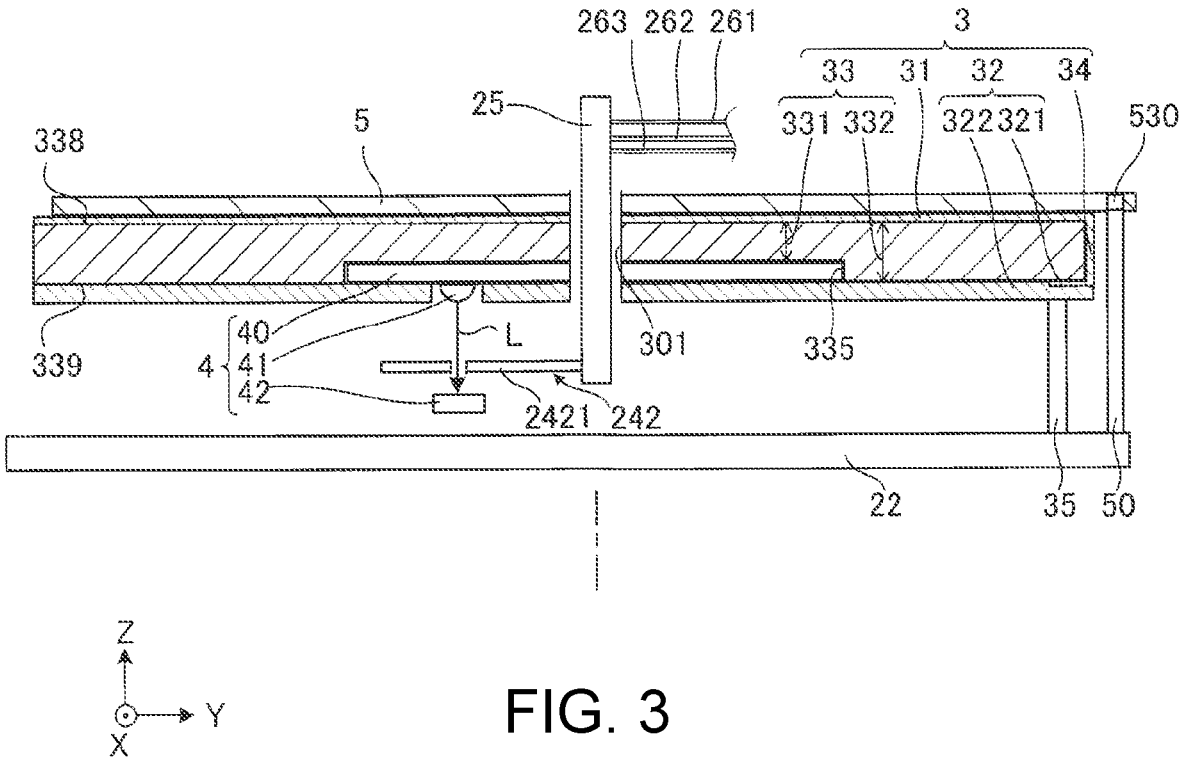
FIG. 3 is a section view of the antenna, LED circuit board, and solar panel in the first embodiment of the invention.
Figure 4:
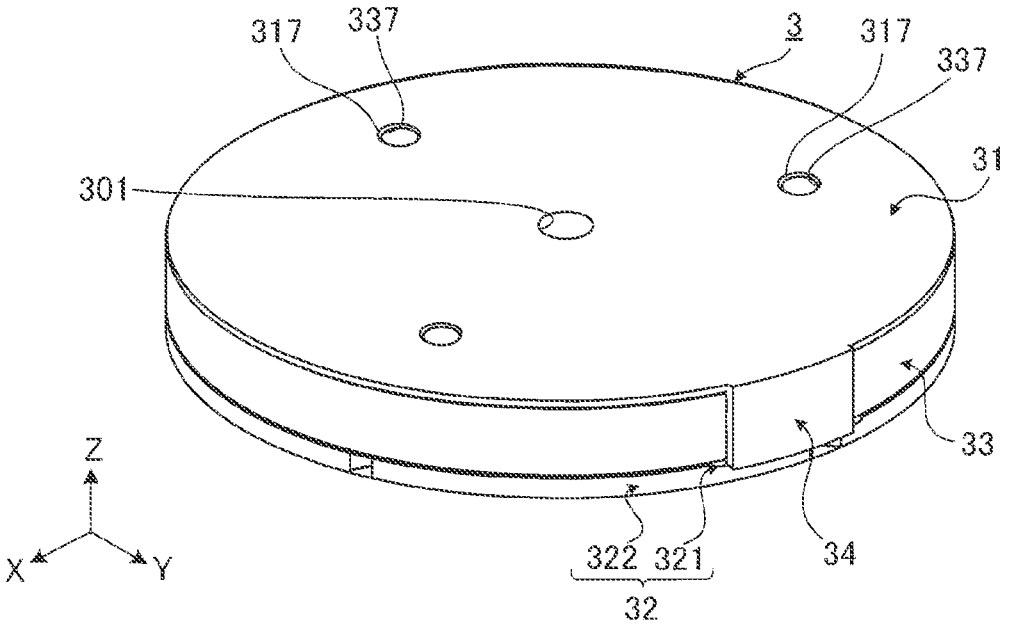
FIG. 4 is a perspective view of the antenna in the first embodiment of the invention.
Figure 5:
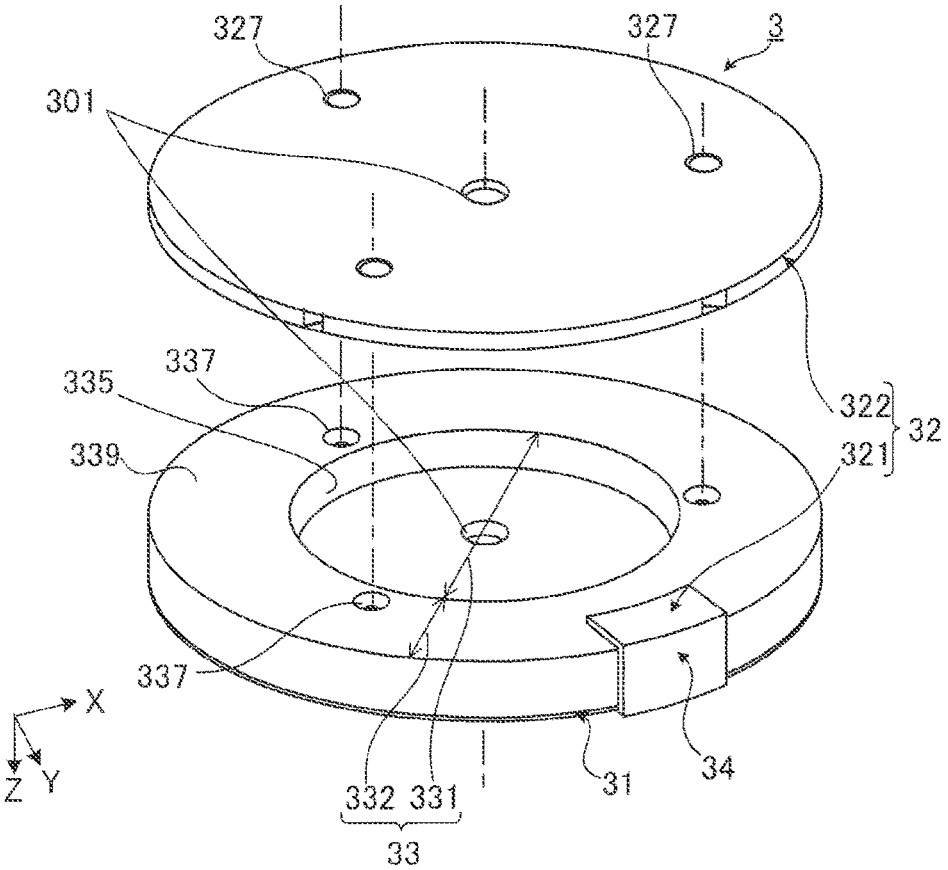
FIG. 5 is an exploded perspective view of the antenna in the first embodiment of the invention.
Figure 6:
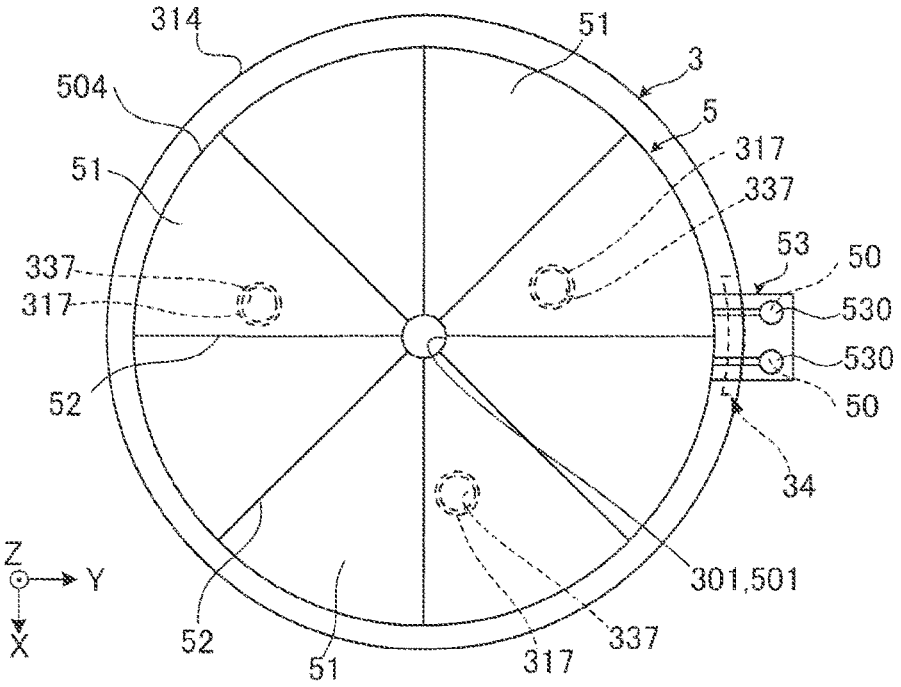
FIG. 6 is a plan view of the antenna and solar panel in the first embodiment of the invention.

FIG. 3 is a section view of the antenna, LED circuit board, and solar panel in the first embodiment of the invention. FIG. 4 is a perspective view of the antenna in the first embodiment of the invention. FIG. 5 is an exploded perspective view of the antenna in the first embodiment of the invention. FIG. 6 is a plan view of the antenna and solar panel in the first embodiment of the invention. Note that the antenna 3, LED circuit board 40, and solar panel 5 are shown schematically for convenience.

1-3A. Antenna

As shown in FIG. 3, FIG. 4, and FIG. 5, the antenna 3 comprises a first conductor element 31, a second conductor element 32, a substrate 33 configured by a dielectric between the first conductor element 31 and second conductor element 32, and a shorting element 34 disposed on the side of the substrate 33. The second conductor element 32 includes a first member 321 and a second member 322.

Note that the antenna 3 is round in plan view, but the shape in plan view is not specifically limited and may be a polygon.

The direction in which the first conductor element 31 and second conductor element 32 are stacked is parallel to the Z-axis.

The first conductor element 31, first member 321, and shorting element 34 are an integrally formed part, and are disposed to outside surfaces of the substrate 33. The first conductor element 31, first member 321, and shorting element 34 are conductive thin films formed on the substrate 33 by plating or vapor deposition. More specifically, the first conductor element 31, first member 321, and shorting element 34 are metal films of copper, silver, or nickel, for example.

Note that the first conductor element 31, first member 321, and shorting element 34 are an integrally formed part, but may be formed as discrete parts. These are also not limited to film configurations, and may be plate members.

The first conductor element 31 functions as a radiating electrode that determines the frequency of the antenna 3 and the polarization of the received radio waves. The first conductor element 31 is connected to a feed pin 35 as the conductive feed element, and is electrically connected to the control circuit board 22 through the feed pin 35. The surface area of the first conductor element 31 is substantially the same as the surface area of the substrate 33, and the first conductor element 31 covers substantially all of one main side 338 of the substrate 33.

Note that the shape of the first conductor element 31 in plan view may be smaller or larger than the shape of the substrate 33 in plan view. As shown in FIG. 4, multiple holes 317 are also formed in the first conductor element 31. The holes 317 are formed at positions corresponding to screw holes 337 in the substrate 33 described below.

The surface area of the holes 317 is greater than the surface area of the screw holes 337. The holes 317 are provided to avoid contact between the first conductor element 31 and screws not shown that pass through the screw holes 337 and are conductively connected to the second conductor element 32.

The second conductor element 32 functions as a ground electrode. As described below, the second conductor element 32 has two members, a film first member 321 and a plate second member 322. The first member 321 functions as a conductor that electrically connects the second member 322 and shorting element 34. As shown in FIG. 5, the shape of the first member 321 in plan view is smaller than the shape of the substrate 33 in plan view, and the first member 321 covers part of the other main side 339 of the substrate 33.

The second member 322 functions as a magnetic shield. The second member 322 is a flat, conductive sheet of pure iron or ferrite stainless steel, for example, coated with a metal layer of copper, gold, or nickel, for example. Because the second member 322 functions as a magnetic shield, a separate magnetic shield is not required, and the parts count of the electronic timepiece 100 can be reduced.

The surface area of the second member 322 is also substantially the same as the surface area of the substrate 33, and the second member 322 is superimposed with the substrate 33 in plan view. Note that the surface area of the second member 322 may be smaller than the surface area of the substrate 33, but is preferably substantially the same as or larger than the area of the substrate 33 to suppress a drop in the sensitivity of the antenna 3. As shown in FIG. 5, multiple screw holes 327 are also formed in the second member 322. The screw holes 327 are disposed to position corresponding to the screw holes 337 in the substrate 33 described below.

The shorting element 34 connects and shorts the first conductor element 31 with the first member 321. The shorting element 34 covers part of the side of the substrate 33. In this embodiment, the shorting element 34 is located on the positive Y-axis side of the substrate 33, that is, at the 12:00 position.

The substrate 33 is an insulating member. The size of the antenna 3 can be reduced by the wavelength shortening effect of the substrate 33. The substrate 33 is preferably configured by a resin. Because a microstrip antenna resonates at $\lambda/2$, a ceramic or other material with a high dielectric constant is used to configure the substrate 33. However, because an inverted-F antenna resonates at $\lambda$/detector 4, even a resin with a low dielectric constant can be made to operate as an antenna 3.

In addition, if the substrate 33 is configured from a ceramic, the cost increases, and the substrate 33 cracks easily and is difficult to process. However, by configuring the substrate 33 from a resin, the cost is lower, resistance to cracking is greater, and processing is easier than when configuring the substrate 33 from a ceramic.

The substrate 33 is preferably configured from a resin with as low a dissipation factor as possible, and more specifically, the substrate 33 is preferably configured from a resin with a dissipation factor of approximately $1\times10^{-4}$. By using a resin with as low a dissipation factor as possible, a drop in the sensitivity of the antenna 3 can be suppressed. Examples of materials suitable for the substrate 33 include acrylic (PMMA), polycarbonate (PC), polypropylene (PP), polyvinyl chloride (PVC), acrylonitrile-butadiene-styrene copolymer (ABS resin) or other thermoplastic resins, phenol resin (PF), epoxy resin (EP), melamine resin (MF), polyurethane resin (PUR), silicon resins (SI) or other thermoset resins.

As shown in FIG. 5, a recess 335 that opens to the back cover side is formed in the substrate 33, and the substrate 33 has a first part 331, and a second part 332 with a thickness that is greater than the thickness of the first part 331 and surrounds the first part 331 in plan view. As described above, by configuring the substrate 33 from a resin, the recess 335 can be formed easily with good dimensional precision.

Also disposed in the second part 332 are multiple screw holes 337 for fixing the antenna 3 to the main plate 21 by means of screws. The antenna 3 is fastened by passing screws not shown through the screw holes 337 and 327. The first conductor element 31, second conductor element 32, and substrate 33 are all fastened at once by screwing screws from the dial 6 side to the main plate 21. The second part 332 contacts the first member 321, and is electrically conductive with the first member 321. When fixed to the substrate 33, the second member 322 closes the opening to the recess 335.

As shown in FIG. 3, the LED circuit board 40 is disposed inside the space formed by the recess 335 and second member 322. The substrate 33 functions as a protective member protecting the LED circuit board 40.

The LED circuit board 40 is positioned by being pushed by the substrate 33 to the second member 322 side, and is held by the substrate 33 so that the LED circuit board 40 cannot shift from this specific position. Note that the shape of the recess 335 is determined appropriately according to the shape of the LED circuit board 40, for example, so that the LED circuit board 40 can be held by the substrate 33.

1-3B. Detector

The detector 4 shown in FIG. 3 detects the position of one or more of the multiple hands 261, 262, and 263. The detector 4 includes an LED or other light-emitting device 41, a photodetector 42, and the LED circuit board 40.

The light-emitting device 41 is mounted on the LED circuit board 40. The light-emitting device 41 emits light L toward a wheel 2421, which in this example is the minute wheel configuring part of the wheel train 242 of the drive mechanism 24. The photodetector 42 is located on the back cover side of the wheel 2421. A hole is formed passing through the thickness of the wheel 2421, and the photodetector 42 emits light L through this hole. The photodetector 42 outputs a signal to the control circuit of the control circuit board 22 according to the detected light L.

The control circuit detects the position of one or more of the multiple hands 261, 262, and 263 based on the signal output from the photodetector 42. The control circuit also determines whether or not hand 261, hand 262, or hand 263 is at a specific position, and if not at the specific position, determines the offset from the position, and corrects the position. As a result, the electronic timepiece 100 can keep accurate time.

1-3C. Solar Panel

The solar panel 5 shown in FIG. 3 is planar, and is held by the antenna 3. The solar panel 5 is bonded to the first conductor element 31 by a double-sided adhesive sheet, for example. Note that the solar panel 5 may disposed separated from the antenna 3 by being supported by a different part not shown instead of the antenna 3.

As shown in FIG. 6, the solar panel 5 has multiple solar cells 51 separated by multiple divider lines 52 extending in a radiating pattern from the through-hole 501 to the outside edge 504. These multiple solar cells 51 are connected in series. Note that while the number of solar cells 51 is eight in the figure, the number is not limited to eight and there may be more or less.

The solar cells 51 are formed by layering in order from the first conductor element 31 side a resin substrate, a metal electrode, a semiconductor layer, a transparent electrode, and a protective layer. The semiconductor layer is formed with an i-type semiconductor between a p-type semiconductor and an n-type semiconductor. Note that the configuration of the solar cells 51 is not limited to this configuration.

The plane area of the solar panel 5 is the same as the plane area of the antenna 3 or less than the plane area of the antenna 3, and the solar panel 5 is covered by the antenna 3 in plan view. In this configuration the outside circumference 314 of the first conductor element 31 of the antenna 3 functions as a radiator that radiates particularly strong radio waves. As a result, by disposing the outside circumference 314 of the first conductor element 31 on the outside of the solar panel 5 in plan view, the effect of the solar panel 5 on the antenna 3 can be reduced, and loss in the reception or transmission performance of the antenna 3 can be suppressed.

The solar panel 5 has a protruding part 53 that protrudes to the outside. The protruding part 53 is formed by a resin substrate and protective layer, for example. Two terminals 530 are also disposed to the protruding part 53. One of the two terminals 530 is a positive terminal, and the other is a negative terminal. The two terminals 530 are connected each connected to a connector 50, which is an electrode connected to the control circuit board 22. The negative terminal of the two terminals 530 is connected to a reference potential. The terminals 530 and connectors 50 are located in plan view outside of the antenna 3.

The configurations of the antenna 3, LED circuit board 40, and solar panel 5 are described above.

As described above, the substrate 33, which is configured by a dielectric that is part of the antenna 3, also has the function of holding the LED circuit board 40 as an example of a timepiece part. Therefore, the antenna 3 functions to receive satellite signals, and functions to hold the LED circuit board 40.

Because the antenna 3 functions to hold the LED circuit board 40 in addition to functioning to receive satellite signals, there is no need for a separate holding member to hold the LED circuit board 40. As a result, the parts count of the electronic timepiece 100 can be reduced, and an increase in the size of the electronic timepiece 100 accompanying an increase in the parts count can be suppressed.

More specifically, the substrate 33 of the parts configuring the antenna 3 holds the LED circuit board 40. As a result, the antenna 3 can be configured by using an existing circuit holding member that holds the LED circuit board 40 as the substrate 33, and disposing the first conductor element 31, second conductor element 32, and shorting element 34 on the circuit holding member. An antenna 3 that also functions to hold the LED circuit board 40 in addition to functioning to receive satellite signals can be manufactured without a great design change. There is therefore no increase in the parts count, and the electronic timepiece 100 can be reduced in size.

To "hold" as used herein means to support a specific timepiece part so that the specific timepiece part does not shift from a specific position.

In addition, the holding function of the substrate 33 includes the ability of the substrate 33 to directly hold the specific timepiece part, and the ability of the substrate 33 to hold the specific timepiece part in cooperation with another part not shown.

The antenna 3 holding a specific timepiece part also includes part of the antenna 3, such as the substrate 33, holding the specific timepiece part.

Furthermore, as described above, a recess 335 is formed in the substrate 33, and the LED circuit board 40 is placed inside the recess 335. More specifically, a recess 335 for holding the LED circuit board 40 is provided in the substrate 33.

Because the LED circuit board 40 can be placed inside the recess 335 of a substrate 33 that has a recess 335, the thickness of a construction including the antenna 3 and the LED circuit board 40 can be made thinner than when the recess 335 is not provided. As a result, the thickness of the electronic timepiece 100 can be made thin. Furthermore, by providing a recess 335, the position of the LED circuit board 40 in the Z-axis direction can be easily determined by placing the LED circuit board 40 inside the recess 335 and pushing the LED circuit board 40 to the back cover side by the substrate 33.

The LED circuit board 40 is disposed within the thickness of the substrate 33. More specifically, in this embodiment the substrate 33 has a first part 331 in which the recess 335 is located, and a second part 332 that surrounds the recess 335 in plan view and is thicker than the first part 331, and the LED circuit board 40 is disposed inside this recess 335. In this embodiment the recess 335 opens to the second member 322 side. The sensitivity of the antenna 3 decreases as the distance between the first conductor element 31 and the second conductor element 32 becomes shorter.

By providing this recess 335 and increasing the thickness of the surrounding part, the distance between the first conductor element 31 and second conductor element 32 can be increased by the second part 332 that is the part thicker than the first part 331 where the recess 335 is disposed. As a result, a large drop in the sensitivity of the antenna 3 can be suppressed without increasing the thickness of the overall structure even when the structure is configured by the antenna 3 and the LED circuit board 40.

This embodiment of the invention uses the LED circuit board 40 as an example of a timepiece part, and the LED circuit board 40 is held by the substrate 33. The LED circuit board 40 can be held stably by holding the LED circuit board 40 with the substrate 33. The antenna 3 can also be manufactured without a great design change by using an existing member as the substrate 33.

Note that a specific timepiece part is a part other than the antenna 3 disposed inside the case 10 of the electronic timepiece 100, and examples of specific timepiece parts include the dial 6 and solar panel 5 in addition to the LED circuit board 40. If the specific timepiece part is the dial 6 or solar panel 5, the dial 6 or solar panel 5 can be held stably, and an antenna 3 can be manufactured without a great design change by using an existing part.

Note that while not shown in the figures, the substrate 33 is not limited to holding the LED circuit board 40, and may be configured to hold part or all of the LED circuit board 40, dial 6, and solar panel 5.

Other examples of specific timepiece parts include the control circuit board 22, a circuit board not shown other than the control circuit board 22 and LED circuit board 40, and rotating indicators such as a date indicator, a day indicator, and a moon phase disk.

As described above the antenna 3 also has a shorting element 34 that shorts the first conductor element 31 and second conductor element 32. Because the current path of the antenna 3 can be increased by having a shorting element 34 compared with a configuration not having a shorting element 34, the size of the antenna 3 in plan view can be reduced. As a result, the electronic timepiece 100 can be made smaller.

As also described above, a through-hole 301 through which the pivot 25 passes is disposed to the antenna 3 at a position different from the shorting element 34. The first conductor element 31 and second conductor element 32 are not electrically conductive with the through-hole 301. Because the antenna 3 has a shorting element 34 on the outside part of the substrate 33 at a position different from the through-hole 301 located in the center of the antenna 3, the first conductor element 31, second conductor element 32, and shorting element 34 can configure an inverted-F antenna that is small and has excellent sensitivity.

The through-hole 301 in this embodiment is located in the center of the antenna 3 in plan view, but the through-hole 301 may be disposed to a position other than the center.

There may also be multiple through-holes through which pivots pass.

The shorting element 34 is disposed to a position at 12:00 in this embodiment, but may be located at a different position. The shorting element 34 of the antenna 3 may be located at a position other than the side of the substrate 33. However, the shorting element 34 is preferably disposed to the outside circumference 314 of the first conductor element 31 or a position closer in plan view to the outside circumference 314 of the first conductor element 31 than the through-hole 301. A small inverted-F antenna with excellent sensitivity can be configured by locating the shorting element 34 at these positions.

As described above, both the first conductor element 31 and first member 321 are integrally formed with the shorting element 34. By integrally forming the first conductor element 31, second conductor element 32, and shorting element 34, the reliability of the connections between the first conductor element 31, second conductor element 32, and shorting element 34 can be increased compared with when these are formed separately and then connected. In addition, there is no need to use separate members to connect these parts together, and the parts count can be reduced.

Note that only one of the first conductor element 31 and second conductor element 32 may be formed integrally with the shorting element 34. Further alternatively, the first conductor element 31, second conductor element 32, and shorting element 34 may be formed separately and then connected together.

The first conductor element 31, second conductor element 32, and shorting element 34 are formed on the substrate 33 by plating or vapor deposition. By integrally forming these on the substrate 33, the parts count can be reduced compared with a configuration that affixes a first conductor element 31 configured by a metal plate to the substrate 33. As a result, increasing the size of the electronic timepiece 100 as a result of increasing the parts count can be suppressed.

By the shorting element 34 being formed on the substrate 33 by plating or vapor deposition, the reception frequency can be easily adjusted by cutting the shorting element 34 by a laser, for example. For example, the reception frequency can be easily adjusted by reducing the width of the shorting element 34. When there are multiple shorting elements 34, the reception frequency can also be adjusted by increasing or reducing the number of shorting elements 34, for example. As a result, there is no need to prepare a different antenna for each model of electronic timepiece 100, and the reception frequency can be adjusted by the shape or number of shorting elements 34.

1-4. Location of the Shorting Element of the Antenna

Figure 7:
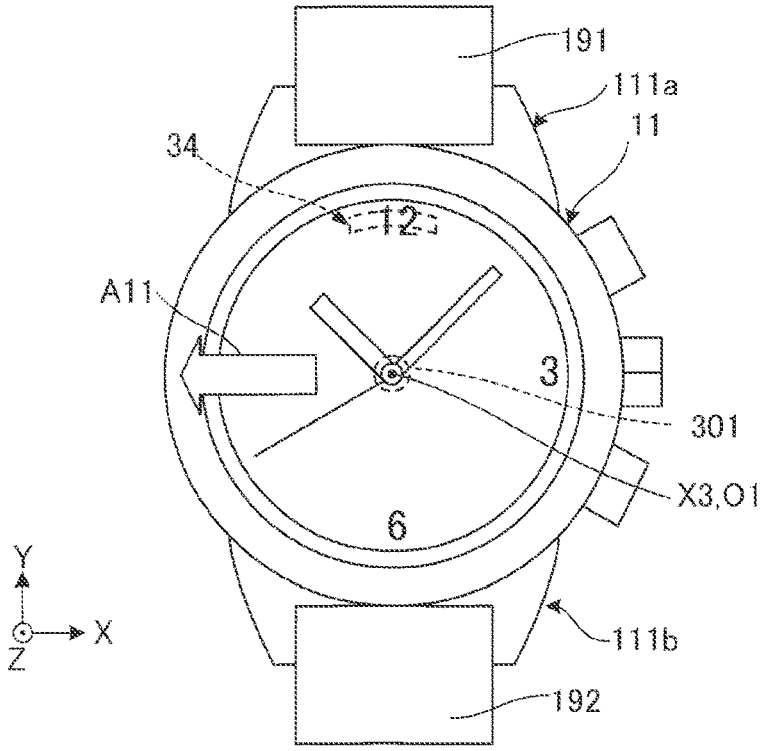
FIG. 7 illustrates the location of the shorting element of the antenna in the first embodiment of the invention.
Figure 8:
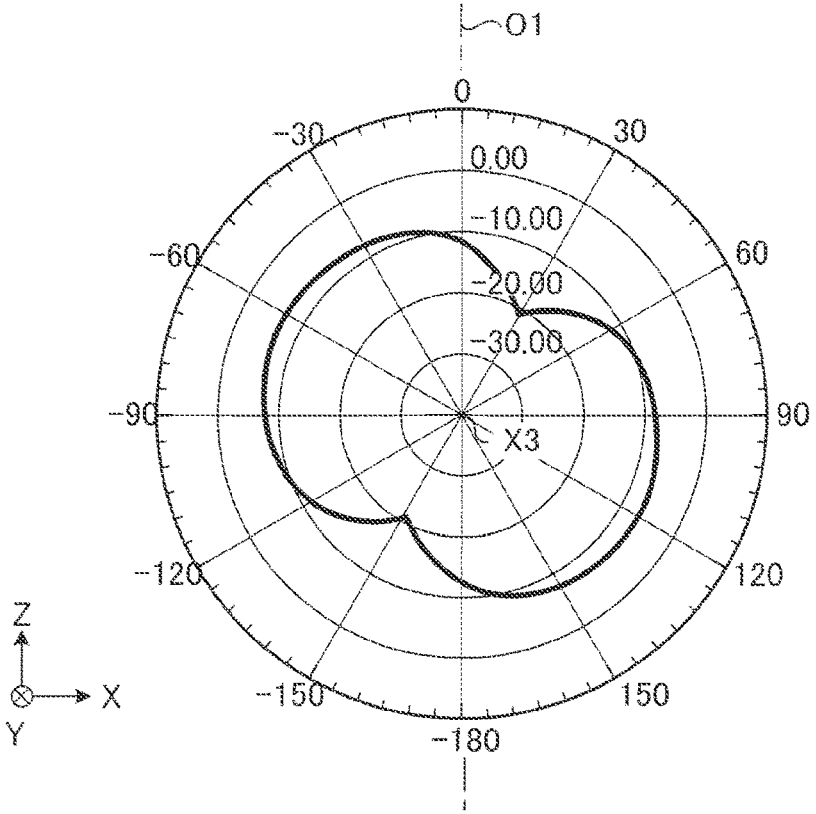
FIG. 8 shows the right circular polarized wave radiation pattern of the antenna in the first embodiment of the invention.

FIG. 7 shows the location of the shorting element 34 of the antenna in the first embodiment of the invention. FIG. 8 shows the right circular polarized wave radiation pattern of the antenna in the first embodiment of the invention. Note that FIG. 8 shows the radiation pattern on the X-Z plane with the origin at the center X3 of the antenna 3. In FIG. 8, 0 is the direction of the center of the dial 6 looking from center X3, 120 is the direction toward the center of the back cover 12 looking from the center X3, 90 is the direction from the center X3 to the 3:00 position on the dial 6, and −90 is the direction from the center X3 to the 9:00 position on the dial 6.

As shown in FIG. 7, the shorting element 34 is located at the 12:00 side from the center X3 of the antenna 3. As described above, the antenna 3 is an inverted-F antenna. The directivity of right circular polarized waves of an antenna 3 that is an inverted-F antenna is biased approximately 60° to the 9:00 side from the center axis O1 through the thickness of the first conductor element 31. As a result, the directivity of right circular polarized waves of the antenna 3 is in the direction of arrow A11 in FIG. 7 in plan view.

In this case, the direction toward 9:00 from the center X3 of the electronic timepiece 100 is substantially vertical when the user wears the electronic timepiece 100 on the left wrist and the arm is hanging naturally down. Because the directivity of right circular polarized waves of the antenna 3 is substantially vertical when the shorting element 34 is offset to the 12:00 side from the center X3, satellite signals can be efficiently received.

Figure 9:
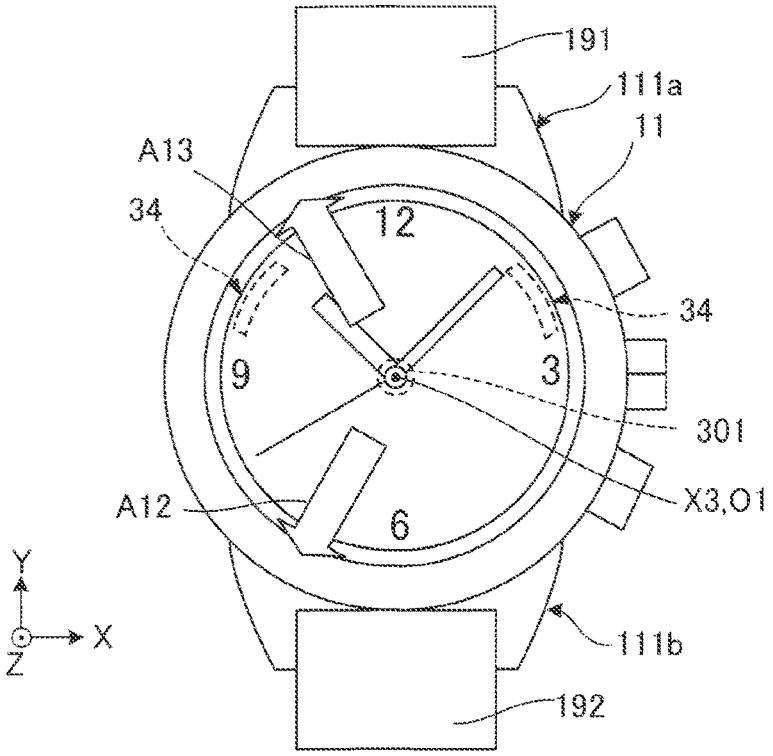
FIG. 9 illustrates the relationship between the location of the shorting element and the right circular polarized wave directivity of the antenna.

FIG. 9 illustrates the relationship between the location of the shorting element and the right circular polarized wave directivity of the antenna.

As shown in FIG. 8, when the shorting element 34 is disposed toward the 10:00 side when looking from the center X3 of the antenna 3, the directivity of right circular polarized waves of the antenna 3 is biased approximately 60° to the 7:00 side from the center axis O1. As a result, the directivity of right circular polarized waves of the antenna 3 is in the direction of arrow A12 in FIG. 9 in plan view.

When the shorting element 34 is disposed toward the 2:00 side when looking from the center X3 of the antenna 3, the directivity of right circular polarized waves of the antenna 3 is biased approximately 60° to the 11:00 side from the center axis O1. As a result, the directivity of right circular polarized waves of the antenna 3 is in the direction of arrow A13 in FIG. 9 in plan view.

When the user wears the electronic timepiece 100 on the left wrist and the arm is hanging down naturally and swinging while the user walks, the directions toward 7:00, 8:00, 9:00, 10:00, and 11:00 seen from the center X3 are substantially vertical. As a result, when the electronic timepiece 100 is intended to be worn on the left wrist, the shorting element 34 is preferably disposed toward the 10:00 side, 11:00 side, 12:00 side, 1:00 side, or 2:00 side from the center X3. In other words, the shorting element 34 is preferably disposed to an angular range from 10:00 to 2:00 clockwise around the center X3 of the antenna 3 in plan view.

When thus configured, the directivity of right circular polarized waves of the antenna 3 is substantially vertical when the electronic timepiece 100 is worn on the left wrist and the user is walking. As a result, satellite signals can be efficiently received while the user is walking.

In addition, satellite signals can be particularly efficiently received by disposing all of the shorting element 34 at the 10:00 side, 11:00 side, 12:00 side, 1:00 side, or 2:00 side in plan view instead of disposing only part of the shorting element 34 at the 10:00 side, 11:00 side, 12:00 side, 1:00 side, or 2:00 side from the center X3 in plan view.

Note that as described above, the plan view is the view when looking in the direction along the Z-axis, which is the direction in which the first conductor element 31 and second conductor element 32 are stacked.

Note that while the electronic timepiece 100 according to the invention to this embodiment is an analog timepiece, when the electronic timepiece 100 is a digital timepiece and used worn on the left wrist, satellite signals can also be efficiently received while walking by similarly disposing the shorting element 34 in an angular range from 10:00 to 2:00 clockwise around the center X3 of the antenna 3 in plan view.

Figure 10:
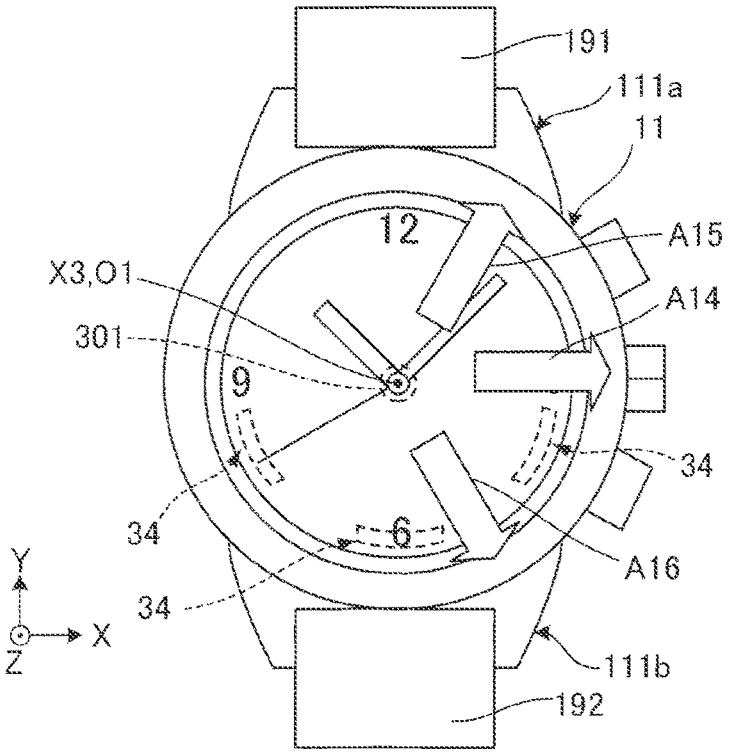
FIG. 10 illustrates the relationship between the location of the shorting element and the right circular polarized wave directivity of the antenna.

FIG. 10 illustrates the relationship between the location of the shorting element and the right circular polarized wave directivity of the antenna in another configuration.

When the shorting element 34 is disposed toward the 6:00 side from the center X3, the directivity of right circular polarized waves of the antenna 3 is biased approximately 60° to the 3:00 side from the center axis O1. As a result, the directivity of right circular polarized waves of the antenna 3 is in the direction of arrow A14 in FIG. 10 in plan view.

In this case, the direction toward 3:00 from the center X3 of the electronic timepiece 100 is substantially vertical when the user wears the electronic timepiece 100 on the right wrist and the arm is hanging naturally down. As a result, when the electronic timepiece 100 is configured to be worn on the right wrist, satellite signals can be efficiently received by disposing the shorting element 34 offset to the 6:00 side from the center X3.

As also shown in FIG. 10, when the shorting element 34 is disposed toward the 4:00 side from the center X3, the directivity of right circular polarized waves of the antenna 3 is biased approximately 60° to the 1:00 side from the center axis O1. As a result, the directivity of right circular polarized waves of the antenna 3 is in the direction of arrow A15 in FIG. 10 in plan view.

Furthermore, when the shorting element 34 is disposed toward the 8:00 side from the center X3, the directivity of right circular polarized waves of the antenna 3 is biased approximately 60° to the 5:00 side from the center axis O1. As a result, the directivity of right circular polarized waves of the antenna 3 is in the direction of arrow A16 in FIG. 10 in plan view.

When the user wears the electronic timepiece 100 on the right wrist and the arm is hanging down naturally and swinging while the user walks, the directions toward 1:00, 2:00, 3:00, 4:00, and 5:00 seen from the center X3 are substantially vertical. As a result, when the electronic timepiece 100 is intended to be worn on the right wrist, the shorting element 34 is preferably disposed toward the 4:00 side, 5:00 side, 6:00 side, 7:00 side, or 8:00 side from the center X3. In other words, the shorting element 34 is preferably disposed to an angular range from 4:00 to 8:00 clockwise around the center X3 of the antenna 3 in plan view.

When thus configured, the directivity of right circular polarized waves of the antenna 3 is substantially vertical when the electronic timepiece 100 is worn on the right wrist and the user is walking. As a result, satellite signals can be efficiently received while the user is walking.

Note that while the electronic timepiece 100 according to the invention to this embodiment is an analog timepiece, when the electronic timepiece 100 is a digital timepiece and used worn on the right wrist, satellite signals can also be efficiently received while walking by similarly disposing the shorting element 34 in an angular range from 4:00 to 8:00 clockwise around the center X3 of the antenna 3 in plan view.

As described above, determining the location of the shorting element 34 in a electronic timepiece 100 that is a wristwatch is effective for particularly efficiently receiving satellite signals. The relationship of the location of the shorting element 34 to the directivity of the antenna when receiving left circular polarized waves is the inverse of the relationship described above.

3. Embodiment 2

4. A Second Embodiment of the Invention is Described Below

Figure 11:
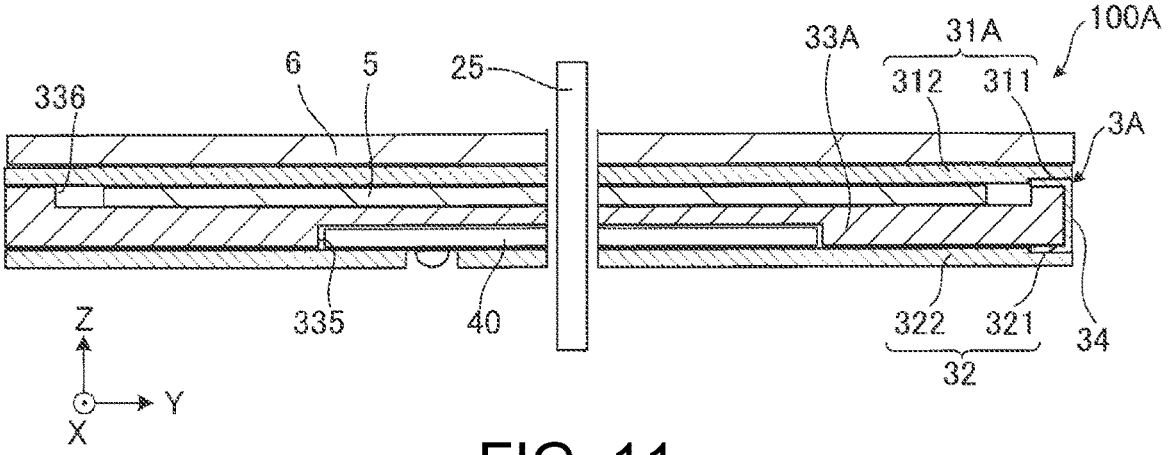
FIG. 11 is a section view of the antenna, LED circuit board, solar panel, and dial in a second embodiment of the invention.

FIG. 11 is a section view of the antenna, LED circuit board, solar panel, and dial in a second embodiment of the invention.

The configuration of the antenna in this second embodiment differs from the first embodiment. The following description focuses on the differences between the second embodiment and the first embodiment, and further description of like elements is omitted or abbreviated. Note also that like parts in the second embodiment and the first embodiment are identified by like reference numerals in FIG. 11.

A recess 336 that opens the face side is formed in the substrate 33A of the antenna 3A of the electronic timepiece 100A shown in FIG. 11. The solar panel 5 is disposed in this recess 336, and the solar panel 5 is held and positioned by the substrate 33A.

The first conductor element 31A of the antenna 3A includes a conductor layer 311 that contacts the substrate 33A, and a conductor plate 312 that contacts the conductor layer 311. The conductor plate 312 is optically transparent. The conductor plate 312 is affixed to the substrate 33A by screws, for example. Because the conductor plate 312 is affixed to the substrate 33A, the conductor plate 312 contacts the conductor layer 311 and conductivity with the conductor layer 311 is assured. In this embodiment of the invention the dial 6 is bonded to the first conductor element 31A by a double sided adhesive sheet, and is thereby held by the antenna 3A.

In this embodiment of the invention the antenna 3A functions as a holding member holding the LED circuit board 40, solar panel 5, and dial 6. Because the antenna 3A functions to receive satellite signals and functions as a holding member, there is no need for a holding member separate from the antenna 3A. As a result, the size of the electronic timepiece 100 can be reduced by using this antenna 3A.

As described above, a recess 335 for holding the LED circuit board 40, and a recess 336 for holding the solar panel 5, are both disposed to the substrate 33A in this embodiment. Therefore, compared with a configuration not having recesses 335 and 336, the thickness of a structure including the antenna 3, LED circuit board 40, and solar panel 5 can be reduced because the LED circuit board 40 is placed in recess 335 and the solar panel 5 is placed in recess 336. As a result, the thickness of the electronic timepiece 100 can be reduced.

In addition, because the distance between the first conductor element 31A and second conductor element 32 can be maintained by the thickness surrounding of recess 336, a large drop in the sensitivity of the antenna 3A can be suppressed without increasing the overall thickness of the substrate 33A.

Note that when the electronic timepiece 100A does not have a solar panel 5, the dial 6, for example, may be disposed in the recess 335.

5. Embodiment 3

6. A Third Embodiment of the Invention is Described Below

Figure 12:
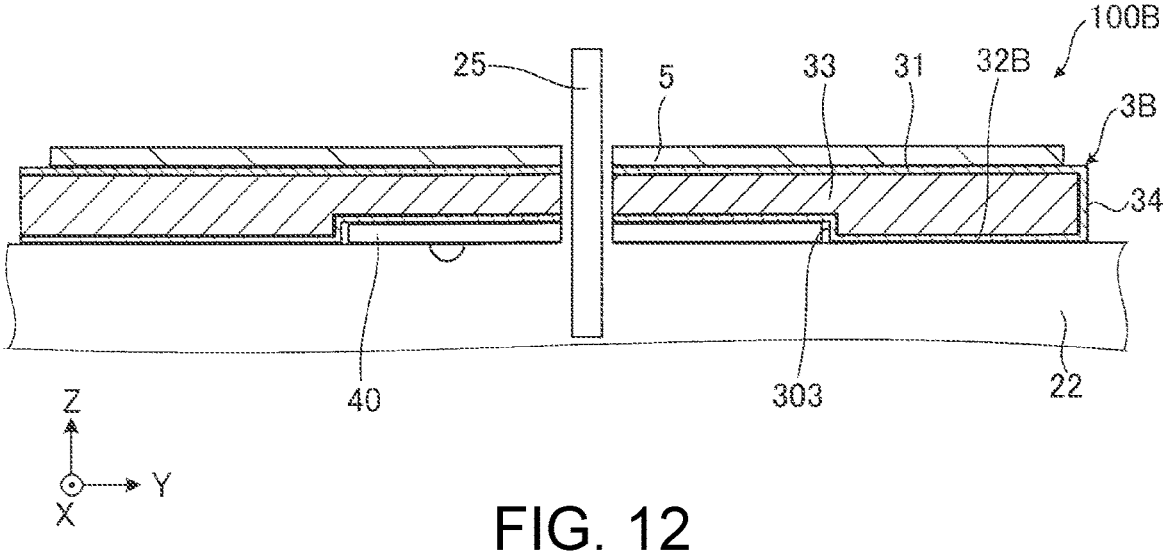
FIG. 12 is a section view of the antenna, LED circuit board, and solar panel in a third embodiment of the invention.

FIG. 12 is a section view of the antenna, LED circuit board, and solar panel in a third embodiment of the invention.

The configuration of primarily the antenna in the third embodiment differs from the first embodiment. The following description focuses on the differences between the third embodiment and the first embodiment, and further description of like elements is omitted or abbreviated. Note also that like parts in the third embodiment and the first embodiment are identified by like reference numerals in FIG. 12.

The second conductor element 32B of the antenna 3B of the electronic timepiece 100B shown in FIG. 12 is integrally formed with the first conductor element 31 and shorting element 34. More specifically, the second conductor element 32B, first conductor element 31, and shorting element 34 are an integrated structure. The second conductor element 32B, first conductor element 31, and shorting element 34 are also conductive thin films formed on the substrate 33 by plating or vapor deposition.

This antenna 3B has a recess 303 that opens to the back cover side. The LED circuit board 40 is disposed in this recess 303. The LED circuit board 40 is pressed and positioned by the antenna 3B to the main plate 21, and held by the antenna 3B so that the position does not shift from a specific position. The LED circuit board 40 is bonded to the antenna 3B by double sided adhesive tape, for example. By using this antenna 3B, there is no need to separately provide a circuit holding member to hold the LED circuit board 40, and increasing the size of the electronic timepiece 100B can be suppressed.

7. Embodiment 4

8. A Fourth Embodiment of the Invention is Described Below

Figure 13:
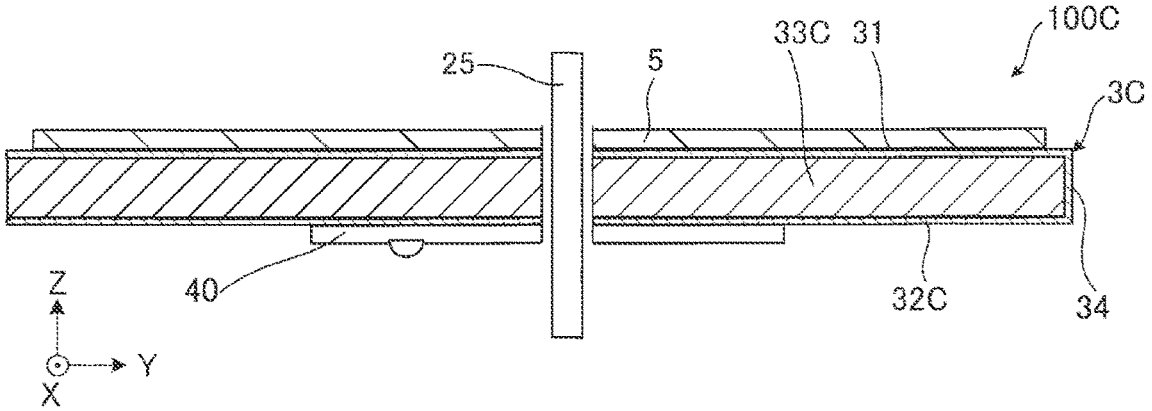
FIG. 13 is a section view of the antenna, LED circuit board, and solar panel in a fourth embodiment of the invention.

FIG. 13 is a section view of the antenna, LED circuit board, and solar panel in the fourth embodiment of the invention.

The configuration of primarily the antenna in the fourth embodiment differs from the first embodiment. The following description focuses on the differences between the fourth embodiment and the first embodiment, and further description of like elements is omitted or abbreviated. Note also that like parts in the fourth embodiment and the first embodiment are identified by like reference numerals in FIG. 13.

The recess 335 of the first embodiment is not provided in the second conductor element 32C of the antenna 3C of the electronic timepiece 100C shown in FIG. 13. The second conductor element 32C, first conductor element 31, and shorting element 34 are an integrated structure, and are conductive thin films formed on the substrate 33C by plating or vapor deposition.

The LED circuit board 40 is held by the antenna 3C. The LED circuit board 40 is bonded to the second conductor element 32C by double sided adhesive tape, for example, and is thereby held by the antenna 3C. Likewise, the solar panel 5 is held by the antenna 3C, and the solar panel 5 is bonded to the first conductor element 31 by double sided adhesive tape, for example, and is thereby held by the antenna 3C.

Because the antenna 3C holds the LED circuit board 40 and solar panel 5, there is no need to separately provide a holding member separate from the antenna 3C to hold the LED circuit board 40 and solar panel 5. The parts count can therefore be reduced.

Note that the antenna 3C may hold the dial 6 or other part instead of the solar panel 5.

9. Embodiment 5

10. A Fifth Embodiment of the Invention is Described Below

Figure 14:
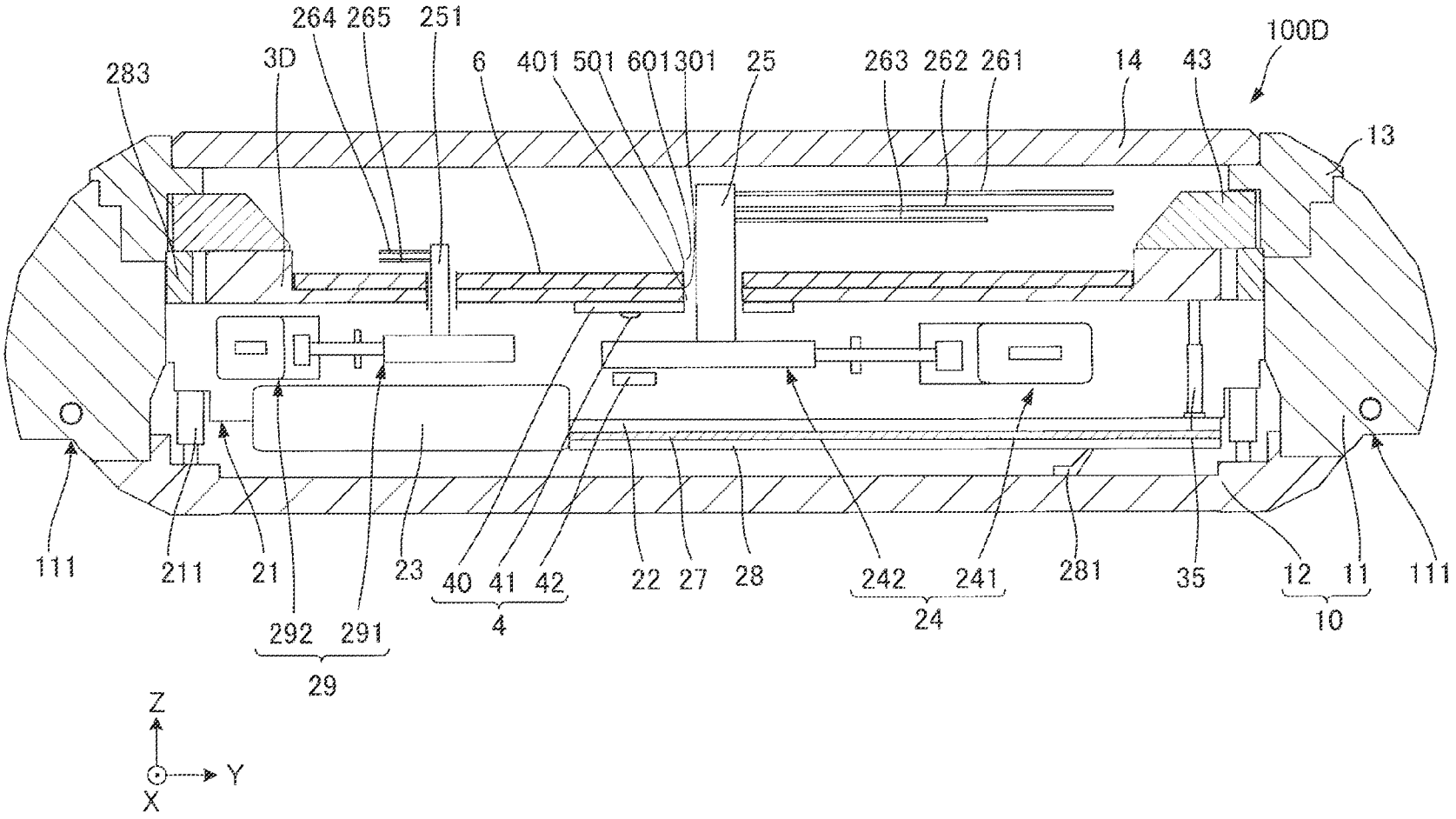
FIG. 14 is a section view of an electronic timepiece according to a fifth embodiment of the invention.
Figure 15:
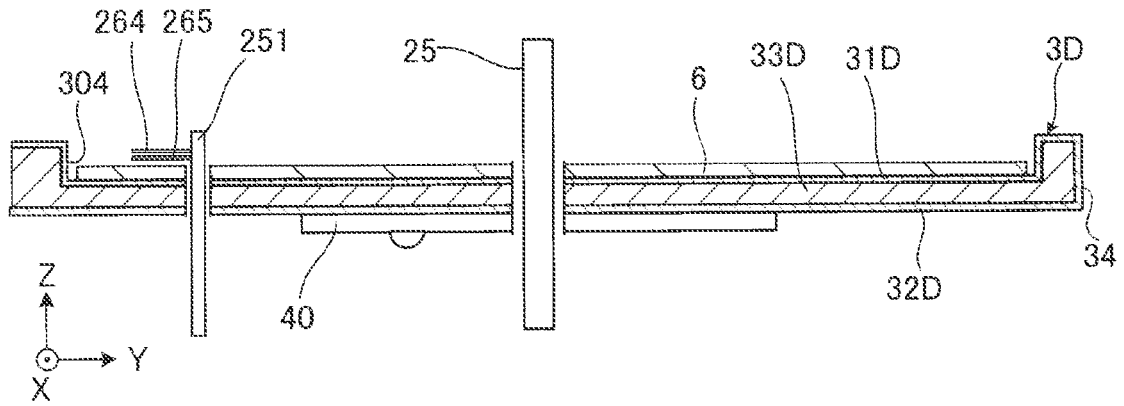
FIG. 15 is a section view of the antenna, LED circuit board, and solar panel in the fifth embodiment of the invention.

FIG. 14 is a section view of an electronic timepiece according to a fifth embodiment of the invention. FIG. 15 is a section view of the antenna, LED circuit board, and solar panel in the fifth embodiment of the invention.

This embodiment of the invention differs from the first embodiment by the electronic timepiece having multiple drive mechanisms and pivots. The following description focuses on the differences between the fifth embodiment and the first embodiment, and further description of like elements is omitted or abbreviated. Note also that like parts in the fifth embodiment and the first embodiment are identified by like reference numerals in FIG. 14 and FIG. 15.

As shown in FIG. 14, the electronic timepiece 100D has a drive mechanism 29, pivot 251, and hands 264 and 265.

The drive mechanism 29 includes a stepper motor 291 as the drive source, and a wheel train 292 as a power transfer mechanism that transfers drive power from the stepper motor 291 to the pivot 251. The pivot 251 is connected to the drive mechanism 29, and the pivot 251 can be driven rotationally by the drive mechanism 29.

The pivot 251 extends from the main plate 21 toward the crystal 14. Multiple hands 264 and 265 for indicating the day of the week, for example, are attached to the pivot 251. The multiple hands 264 and 265 are located on the crystal 14 side of the dial 6, and rotate on the pivot 251.

Note that the electronic timepiece 100D according to this embodiment does not have the solar panel 5 of the first embodiment.

As shown in FIG. 15, the antenna 3D has a first conductor element 31D, a second conductor element 32D, a substrate 33D, and a shorting element 34. The first conductor element 31D, second conductor element 32D, substrate 33D, and shorting element 34 are integrally formed, and are conductive thin films formed on the substrate 33D by plating or vapor deposition.

This antenna 3D has a recess 304 that opens to the face side. The dial 6 is disposed in this recess 304. The dial 6 is bonded to the first conductor element 31D by a double sided adhesive sheet, for example, and is thereby held by the antenna 3D. The hands 264 and 265 are disposed in this recess 304. As described above, because the antenna 3D functions as a holding member that holds the dial 6, there is no need for a member separate from the antenna 3D to hold the dial 6. The parts count of the electronic timepiece 100D can therefore be reduced. In addition, because the recess 304 is surrounded by a convex member, the volume of the antenna 3D is increased and the gain of the antenna 3 is improved.

The present invention is described with reference to preferred embodiments described above, but the invention is not limited thereby. The configurations of parts of the invention can also be replaced by desirable configurations of the same or equivalent function, and other desirable configurations can be added.

The electronic timepiece of the invention is also not limited to a wristwatch, and may be a table clock, wall clock, or other type of timepiece.

A GPS antenna with the ability to receive GPS satellite signals is used as an example of the antenna in the foregoing embodiments, but the antenna may be configured in various ways having at least a first conductor element, second conductor element, and dielectric, and is not limited to being a GPS antenna. For example, the antenna may be configured to receive satellite signals from other positioning information satellites such as used in the Galileo (EU), GLONASS (Russia), and BeiDou (China) systems, or to receive satellite signals from geostationary satellites such as SBAS or quasi-zenith satellites. The antenna may also be configured to receive Bluetooth or other wireless near-field communication signals. Note that Bluetooth is a registered trademark.

In addition, the antenna in the foregoing embodiments is a planar inverted-F antenna, the shape of the antenna is not limited to planar. Furthermore, the may be variously configured with at least a first conductor element, second conductor element, and dielectric, and may be a microstrip antenna.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An electronic timepiece comprising:

a case;

a dial;

a hand that is configured to indicate a time;

a pivot to which the hand is attached;

a drive mechanism that is configured to drive the pivot;

a base plate that is configured to hold the drive mechanism;

a timepiece part disposed inside the case; and an antenna having a first conductor element connected to a feed, a second conductor element disposed superimposed with the first conductor element in plan view, and a dielectric disposed between the first conductor element and second conductor element, the antenna holding the timepiece part, wherein the antenna is planar, disposed between the dial and the base plate, and has a through-hole through which the pivot passes.

2. The electronic timepiece described in claim 1, wherein:

the timepiece part is a dial, solar panel, or circuit board.

3. The electronic timepiece described in claim 1, wherein:

the timepiece part is disposed between the second conductor element and the dielectric; and the timepiece part is affixed to the second conductor element and the dielectric.

4. The electronic timepiece described in claim 3, wherein:

the dielectric has a recess that opens to the second conductor element side; and the timepiece part is disposed in the recess.

5. The electronic timepiece described in claim 3, wherein:

the antenna fixes the second conductor element and the dielectric by a screw.

6. The electronic timepiece described in claim 1, wherein:

the antenna and the timepiece part are adhesively bonded.

7. The electronic timepiece described in claim 1, further comprising:

a main plate; and the timepiece part is disposed between the main plate and the antenna, and the antenna holds the timepiece part by pressing the timepiece part to the main plate.

8. The electronic timepiece described in claim 1, wherein:

the antenna has a shorting element that shorts the first conductor element and second conductor element.

9. The electronic timepiece described in claim 8, wherein:

the shorting element is disposed at a position in an angular range from 10:00 to 2:00, or an angular range from 4:00 to 8:00, clockwise referenced to a center of the antenna in plan view.

10. The electronic timepiece described in claim 1, wherein:

the dielectric is configured by a resin.

11. The electronic timepiece described in claim 1, wherein:

the timepiece part is disposed within a thickness of the dielectric.

12. An electronic timepiece comprising:

a case;

a timepiece part disposed inside the case; and an antenna having a first conductor element connected to a feed, a second conductor element disposed superimposed with the first conductor element in plan view, and a dielectric disposed between the first conductor element and second conductor element, the antenna holding the timepiece part, wherein the antenna has a shorting element that shorts the first conductor element and second conductor element, and the shorting element is disposed at a position in an angular range from 10:00 to 2:00, or an angular range from 4:00 to 8:00, clockwise referenced to a center of the antenna in plan view.

* * * * *